United States Patent [19]

Armour

[11] Patent Number: 4,825,849

[45] Date of Patent: May 2, 1989

[54] FIREPLACE AIR SUPPLY

[76] Inventor: Willys R. Armour, 127 Frank Street, Carleton Place, Ontario, Canada, K7C 3A2

[21] Appl. No.: 237,177

[22] Filed: Aug. 29, 1988

Related U.S. Application Data

[63] Continuation of Ser. No. 898,588, Aug. 21, 1986, abandoned.

[30] Foreign Application Priority Data

Jan. 8, 1986 [CA] Canada ..... 499190

[51] Int. Cl.[4] ..... F24B 7/00

[52] U.S. Cl. ..... 126/518; 126/515; 126/500

[58] Field of Search ..... 165/DIG. 2; 126/292, 126/500, 515, 517, 518, 15 R

[56] References Cited

U.S. PATENT DOCUMENTS

| | | | |
|---|---|---|---|
| 914,922 | 3/1909 | Cahoone | 126/77 |
| 4,106,475 | 8/1978 | Mayers | 126/121 |
| 4,170,219 | 10/1979 | Hansen et al. | 126/121 |
| 4,266,525 | 5/1981 | Hall | 126/121 |
| 4,372,288 | 2/1983 | Nicholas | 126/143 |
| 4,409,956 | 10/1983 | Barnett | 126/290 |
| 4,471,755 | 9/1984 | Faehling et al. | 126/121 |

*Primary Examiner*—Larry Jones
*Attorney, Agent, or Firm*—Pascal & Associates

[57] ABSTRACT

An outside air supply control apparatus for a fireplace comprising a first cylindrical pipe for connection to an outside air supply, the pipe containing at least one aperture in its wall. A second cylindrical pipe having an inside diameter slightly larger than the outside diameter of the first pipe, and having a closed end, is disposed coaxially over the end of the first pipe. The second pipe has an aperture in its wall which can overlap the aperture in the wall of the first pipe when rotated to a first position, and has an unapertured portion which can completely block the aperture in the wall of the first pipe when rotated to a second position. Preferably the apparatus includes a closed cylindrical cap having an inside diameter which is much greater than the outside diameter of the second pipe, disposed concave down over, and being fixed to the second pipe, whereby the second pipe can be rotated upon rotation of the cap and whereby outside air passing through coincident apertures in the pipes is deflected downwardly. Thus the cap both deflects the air and stops any ash or burning debris from passing through the coincident apertures. Yet the amount of air supplied to the fire can be controlled to a very fine degree by rotating the cap.

17 Claims, 2 Drawing Sheets

FIREPLACE AIR SUPPLY

Figure 1:
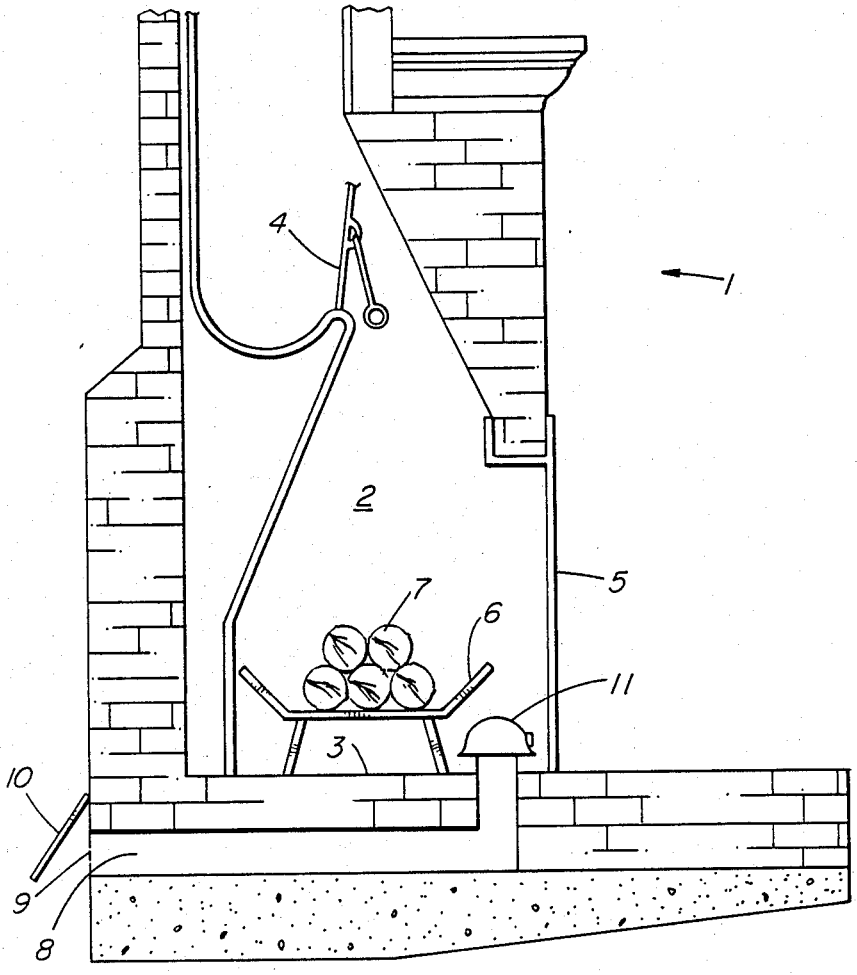

This is a continuation of application Ser.. No. 898,588 filed Aug. 21st, 1986, now abandoned.

This invention relates to an outside combustion air supply control apparatus for use in a fireplace.

With homes being more tightly sealed in order to reduce the cost of fuel, the supply of fresh combustion air to a fireplace used in the home has become essential. Many fireplaces today are fabricated with a vertical pipe through its floor, the bottom of which is expected to be connected to a source of outside air.

The provision of outside air to a fireplace in this manner presents many problems. Ashes or burning fuel can drop into the pipe which passes through the floor of the fireplace, which could create a hazard. Secondly, the source of outside air should have a shut-off valve or damper. Preferably the amount of outside air introduced should be able to be controlled.

Several previous inventions have attempted to solve the aforenoted problems. U.S. Pat. No. 4,372,288 issued Feb. 8th, 1983 to James E. Nicholas describes the use of an elongated air manifold disposed along the front of the fireplace with orifices allowing ingress of outside air. A slider plate having matching holes can close the orifices. While this structure can provide a satisfactory supply of outside air, because the orifices face upwardly, over time ashes and debris can drop through, clogging up the pipe which provides the air supply. Without dismantling the structure the pipe cannot be cleaned.

Another structure similar to that described above is described in U.S. Pat. No. 4,184,474 issued January 22nd, 1980 to James B. Pulliam et al. Both the basic structure and the attendant problems of ash and other debris falling into the air supply pipe are present.

In U.S. Pat. No. 4,266,525 issued May 12th, 1981 to John R. Hall, the air supply pipe rises from the floor to the fireplace, and contains a horizontal cap spaced above the top of the pipe. The cap restricts the deposit of ash and burning debris into the air supply pipe. Yet because of the spacing between the cap and the top of the pipe, air can be provided. However in order to control the amount of air provided to the fireplace an elongated valve control rod is used which extends to a valve at an inlet orifice below and behind the fireplace. The fireplace must have a rather complicated floor structure, with a raised hearth and a linkage to the fresh air inlet valve. The structure is thus relatively expensive.

The present invention is a fresh air supply control which requires no complicated linkage or structures to an air inlet pipe. There is virtually no possibility of ash or burning debris passing back through the air inlet pipe. At the same time the user can control to a very fine degree the amount of air supplied to a fire. Further, the air inlet supply control apparatus can be placed so that the air introduced can cool glass doors for the fireplace if such are used, reducing any breakage hazard which may be caused by the heat of the fire.

The advantages of the invention are obtained in an outside air supply control apparatus for a fireplace comprising a first cylindrical pipe for connection to an outside air supply, the pipe containing at least one aperture in its wall. A second cylindrical pipe having an inside diameter slightly larger than the outside diameter of the first pipe, and having a closed end, is disposed coaxially over the end of the first pipe. The second pipe has an aperture in its wall which can overlap the aperture in the wall of the first pipe when rotated to a first position, and has an unapertured portion which can completely block the aperture in the wall of the first pipe when rotated to a second position.

Preferably the apparatus includes a closed end cylindrical cap having an inside diameter which is much greater than the outside diameter of the second pipe, disposed concave down over, and being fixed to the second pipe, whereby the second pipe can be rotated upon rotation of the cap and whereby outside air passing through coincident apertures in the pipes is deflected downwardly.

Thus the cap both deflects the air and stops any ash or burning debris from passing through the coincident apertures. Yet the amount of air supplied to the fire can be controlled to a very fine degree by The height of the cap, and the height of the second pipe are of course less than the height of the first pipe above the floor of the fireplace leaving a space between the bottom lip of the cap and the floor of the fireplace. This space should be sufficient to allow the air to pass thereunder and into the fire. In the case in which the air supply pipe is located adjacent the front of the fireplace, the combustion air supplied therethrough also passes upwardly over the inside of any glass doors which may close the front of the fireplace, cooling it. The overall height of the entire apparatus is preferably less than the height of the bottom of a grate which is usually used in a fireplace.

Preferably the cap is bell-shaped, and a handle may be applied to it in order to facilitate both turning, and recognition of a degree to which the control is open.

Figure 2:
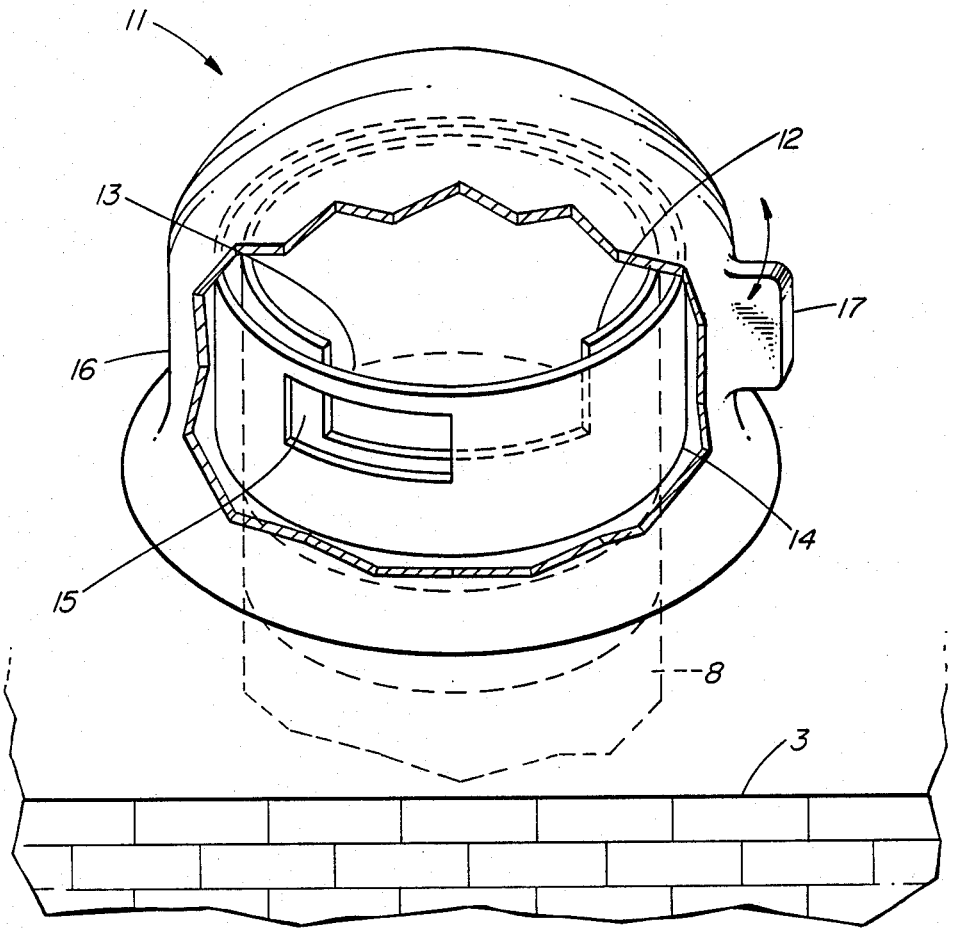

A better understanding of the invention will be obtained by reference to the detailed description below, in combination with the following drawings, in which:

FIG. 1 is a side sectional view of a fireplace using the present invention, and FIG. 2 is a perspective cut-away view of the present invention.

FIG. 1 illustrates a cut-away view of a fireplace 1, comprised of a combustion chamber 2, a fireproof floor 3 and a damper 4. Glass doors 5 may seal off the front of the fireplace. A fireplace grate 6 suspends fuel such as logs 7 above the floor 3.

In order to supply combustion air a pipe 8 communicates with the outside, and passes upwardly through the floor 3 of the fireplace. A screen 9 which closes the outside end of the pipe 9 prevents insects from entering the pipe, and an outside spring loaded or air pressure operated damper 10 can close the outside entrance to the pipe 8 when air is not being drawn through it.

An outside air supply control apparatus 11 in accordance with the present invention extends upwardly from the pipe 8 to both control and direct the flow of fresh outside air into the combustion chamber 2.

A cut-away perspective view of the control apparatus 11 is shown in FIG. 2, with the hidden parts shown in phantom with dashed lines. The pipe 8 extends upwardly through the floor 3 of the fireplace. Either the pipe itself or an extension which is fitted to it, comprising a first cylindrical pipe 12 contains an aperture 13 in its wall. The aperture can extend to the end of the pipe. Preferably the top edge of the pipe is horizontal.

A second cylindrical pipe 14 surrounds pipe 12, the inner diameter of pipe 14 being slightly larger than the outside diameter of pipe 12. The spacing between the pipes has been shown exaggerated for clarity, but in actual practice the clearance between them will be only sufficient to allow non-binding rotation of pipe 14 around pipe 12.

The second pipe 14 contains an aperture 15 in its wall. The size of the aperture 15 is such that upon rotation of pipe 14 around the perimeter of pipe 12, aperture 15 can substantially align itself and uncover aperture 13. Yet there should be sufficient unapertured wall in pipe 14 so that it can be rotated and the unapertured portion of pipe 14 cover, and thus close, aperture 13.

While aperture 15 has been shown as a window in the wall of pipe 14, it can extend to the end of pipe 14. Pipe 14 should have a closed end, which will maintain it in position over pipe 12.

A cap 16 is preferably located over pipe 14. Cap 16 is cylindrical in shape, having a diameter which is considerably greater than the outside diameter of pipe 14. While cap 16 can be formed out of a closed end piece of pipe, preferably it has a top end which has a large radius periphery, or even more preferably the cap is bell-shaped as shown in FIG. 2. The end of the pipe 14 should be fixed to the concave inside end of cap 16. Indeed, cap 16 can form the closure to pipe 14. Preferably a handle 17 is provided outside of the cap. The handle can be grasped, and the cap 16 turned thereby, in order to turn pipe 14 and thereby either close or open the aperture 13 by causing registration or lack of registration by aperture 15.

In one useful embodiment, apertures 13 and 15 extend over an arc of 160°. Aperture 13 can be about 1½ inches high. Aperture 15 can be e.g. 1¼ inches high, being spaced from the top of pipe 14 about ¼ inch. The distance that pipe 12 extends above the floor of the fireplace can be 2 inches. The bottom of cap 16 can be typically ½ to ¾ inch above the floor of the fireplace. The diameter of pipe 12 can be 4 inches and the nominal diameter of the cap be 6 inches.

It should be noted that rather than using only single apertures 12 and 13, several apertures can be spaced around the walls of the pipes. In that case the arc length of each aperture would be less than that described above. This will result in the requirement to rotate cap 16 over a much smaller arc than is required in the structure having a single very wide aperture in each pipe.

In operation, air passes from the outside through pipe 8, up pipe 12, through aperture 13, through aperture 15, into the concave portion of cap 16, from where it is deflected downwardly toward the floor 3 of the fireplace. It then spreads outwardly and then provides a supply of fresh air for combustion within the combustion chamber 2.

In order to control the amount of combustion air supplied to the fire, handle 17 is grasped, and cap 16 is rotated. Control over the overlap of the gaps is thus obtained to a very fine degree. By observing the location of handle 17, the degree of opening or closure of gap 13 can be estimated. The supply of combustion air can of course be completely shut off by aligning the aperture 13 with the unapertured portion of pipe 14.

As noted earlier, it is preferred that the overall height of the air supply control apparatus should be less than that of the bottom of the grate 6. More than one control apparatus can be used, e.g. two being located on opposite sides of the fireplace. Preferably the apparatus is located adjacent the front of the fireplace as shown in FIG. 1. In this case combustion air passing around the bottom of cap 16 will pass upwardly along the inside of glass doors 15 (if used), cooling them. This substantially reduces the danger of the doors breaking under the influence of a very hot fire.

A person understanding this invention may now conceive of alternative structures or other embodiments using the principles described herein. All are considered to be within the sphere and scope of the invention as defined in the claims appended hereto.

I claim:

1. Outside air supply control apparatus for a fireplace comprising:

(a) a first cylindrical pipe for connection to an outside air supply, the pipe containing at least one aperture in its wall, (b) a second cylindrical pipe having an inside diameter slightly larger than the outside diameter of the first pipe, having a sealed end, and being disposed coaxially over the upper end of the first pipe, the second pipe having an aperture in its wall which can overlap the aperture in the wall of the first pipe when rotated to a first position, and having an unapertured portion which can completely block the aperture in the wall of the first pipe when rotated to a second position, and (c) a closed cylindrical cap, having an inside diameter which is much greater than the outside diameter of the second pipe, disposed concave down over, fixed to, and having its lower edge extending substantially below the aperture in the second pipe so as to deflect air egressing the aperture downwardly while at the same time protecting ash surrounding the apparatus from being swept into the second pipe and deflecting any downdrafts away from the aperture, and the second pipe being rotated upon rotation of the cap.

2. Outside air supply control apparatus for a fireplace as defined in claim 1, in which the aperture in the first pipe is located adjacent an upper end thereof.

3. An apparatus as defined in claim 2 in which the first pipe is a first height above the floor of the fireplace, and the height of the cap is less than said first height whereby said outside air can egress between the bottom edge of the cap and the floor of the fireplace.

4. An apparatus as defined in claim 3 further including a handle attached to the cap.

5. An apparatus as defined in claim 3 in which the cap has an upper edge with a large radius.

6. An apparatus as defined in claim 3 in which the cap is bell-shaped.

7. An apparatus as defined in claim 3 in which the overall height of the apparatus above the floor of the fireplace is less than the height of the bottom of a fireplace grate.

8. A fireplace comprising:

(a) a fireproof floor, (b) a first cylindrical pipe passing upwardly through the floor for carrying fresh combustion air into the fireplace, extending above the floor a predetermined distance, the pipe having at least one aperture in its wall adjacent its end above the floor, (c) a second cylindrical pipe having an inside diameter slightly greater than the outside diameter of the first pipe, and a length less than said predetermined distance fitted coaxially over said end of the first pipe, and having an aperture in its wall which can overlap the aperture in the wall of the first pipe when rotated to a first position, and having an unapertured portion which can completely block the aperture in the wall of the first pipe rotated to a second position, (c) a cap comprising of a cylindrical portion having inside diameter much greater than the outside diameter of the second pipe, a length which is less than said predetermined distance, and a closed end fixed to and sealing the end of the second pipe above the first pipe, whereby rotation of the cap causes rotation of the second pipe and blockage or coincidental opening of the apertures whereby said combustion air can pass upwardly through the first pipe, through both apertures and under the bottom of the cap.

9. A fireplace as defined in claim 8 in which the aperture in the first pipe extends to its upper end.

10. A fireplace as defined in claim 8 in which the cap is bell-shaped.

11. A fireplace as defined in claim 8 in which the fireplace has an open front, and in which the first pipe extends upwardly adjacent the front of the fireplace, and further including glass doors for closing the front of the fireplace.

12. A fireplace as defined in claim 10 further including a handle attached to the outside of the cap.

13. Outside air supply control apparatus for a fireplace comprising:

(a) a first pipe for connection to an outside air supply and for extending upwardly from the floor of a fireplace, (b) a closed end cylindrical cap mounted coaxially with the first pipe over the end of the first pipe, having an inside diameter substantially greater than the outside diameter of the first pipe, (c) a port for allowing air in the first pipe to egress to an inside wall of the cap, (d) manually slideable means for closing the port, whereby substantially all air passage to and from said pipe is blocked, (e) the bottom edge of the cap extending to a position substantially below the port to a position close to said floor, whereby air egressing the aperture is deflected downwardly to the fireplace floor while at the same time ash is protected from entering the aperture and any downdrafts are deflected away from the aperture.

14. Apparatus as defined in claim 13 in which the manually slideable means is comprised of a second pipe disposed coaxially over the end of the first pipe, both the first and second pipes being cylindrical, the inside diameter of the second pipe being slightly larger than the outside diameter of the first pipe, means for sealing the end of the first pipe, the port in the first pipe being an aperture in its wall, the second pipe having an aperture in its wall which can overlap the aperture in the wall of the first pipe when coaxially rotated to a first position, and having an unapertured portion which can completely block the aperture in the wall of the first pipe when rotated to a second position.

15. Apparatus as defined in claim 14 in which the cap is fixed to the second pipe, which can be rotated thereby rotating the second pipe blocking or unblocking the aperture.

16. Apparatus as defined in claim 15 in which the end of the cap forms an end seal for the second pipe and thus forms said means for sealing the end of the first pipe.

17. Apparatus as defined in claim 15 in which the end of the second pipe is closed, thus forming said means for sealing the end of the first pipe.

* * * * *